US006848220B2

(12) United States Patent
Faurholdt et al.

(10) Patent No.: US 6,848,220 B2
(45) Date of Patent: Feb. 1, 2005

(54) FLASHING

(75) Inventors: Jesper Henrik Faurholdt, Lyngby (DK); Jan Fahlén Jensen, Søborg (DK); Lars Jørn Nissen-Schmidt, Søborg (DK); John E. Lawton, Jr., Abbeville, SC (US); Wayne Quarles, Greenwood, SC (US)

(73) Assignee: VKR Holding A/S, Søborg (DK)

( * ) Notice: Subject to any disclaimer, the term of this patent is extended or adjusted under 35 U.S.C. 154(b) by 26 days.

(21) Appl. No.: 10/318,373

(22) Filed: Dec. 13, 2002

(65) Prior Publication Data

US 2004/0111981 A1 Jun. 17, 2004

(51) Int. Cl.[7] ..... E04D 1/36
(52) U.S. Cl. ..... 52/58; 52/98
(58) Field of Search ..... 52/52, 98, 58, 52/200, 60, 100, 219, 302.6

(56) References Cited

U.S. PATENT DOCUMENTS 2,851,973 A * 9/1958 Lenke et al. ..... 52/200
3,838,544 A * 10/1974 Hindall ..... 52/60
4,563,847 A * 1/1986 Hasty ..... 52/219
5,319,898 A * 6/1994 Freiborg ..... 52/52
6,269,591 B1 * 8/2001 Kelly ..... 49/482.1
6,374,549 B1 * 4/2002 Mayle ..... 52/58
6,383,594 B2 * 5/2002 Weinstein et al. ..... 428/43
6,401,402 B1 * 6/2002 Williams ..... 52/58
2004/0103592 A1 * 6/2004 Edvardsen ..... 52/58

FOREIGN PATENT DOCUMENTS

WO WO 02/42578 A1 5/2002

* cited by examiner

*Primary Examiner*—Milton Nelson, Jr.
(74) *Attorney, Agent, or Firm*—Merek, Blackmon & Voorhees, LLC

(57) ABSTRACT

A flashing for weather proof sealing of the transition between a roof covering and a constructional element rising from a roof surface, such as a curb of a skylight, comprises an elongated flashing profile strip with a first profile portion for abutment against the constructional element and a second profile portion for extending along the roof surface. The first profile portion has a defined width transverse to a longitudinal direction of the profile strip, and the first profile portion comprises a separation line running in the longitudinal direction of the profile strip. The separation line facilitates separation of an outer part of the first profile portion.

15 Claims, 2 Drawing Sheets

FLASHING

BACKGROUND OF THE INVENTION

The present invention relates to a flashing for weather proof sealing of the transition between a roof covering and a constructional element rising from a root surface, such as a curb of a skylight, said flashing comprising an elongated flashing profile strip with a first profile portion for abutment against the constructional element and a second profile portion for extending along the roof surface, said first profile portion having a defined width transverse to a longitudinal direction of the profile strip.

Flashings are commonly used e.g. to provide a weather proof sealing between a roof surface and the frame or curb of a roof window or skylight.

Roof windows are delivered by a manufacture as a complete construction including a frame for mounting on the construction of the roof. In such a case it is possible for the manufacture to deliver also a flashing that will fit the frame.

However skylights are often delivered as a sash with glazing but without a frame. Instead the person building-in the skylight will build on-site a curb for the skylight from timber of dimensions 2"×6" (inches) or 2"×4" (inches). In such a case it has hitherto not been possible to provide a flashing that will fit the curb in all cases, because the selection of timber is more or less arbitrary.

Providing a flashing that will fit a curb of 2"×6" (inches) timber will entail the need for cutting off an outer part of the first profile portion of the profile strip if 2"×4" (inches) timber is used for the curb. This in turn entails the risk of to much being cut of, the flashing being as a consequence not able to provide a weather proof sealing. Another situation even worse would be if a flashing intended for a curb of 2"×4" (inches) timber was used for a curb of 2"×6" (inches) timber because the flashing would then definitely be to low.

BRIEF SUMMARY OF THE INVENTION

In view of the above it is an object of the invention to provide a flashing for weather proof sealing of the transition between a roof covering and a constructional element rising from a roof surface, such as a curb of a skylight of a so-called curb and lens construction, said flashing comprising a sheet material flashing profile strip divided by a bend into a first profile portion for abutment against the constructional element and a second profile portion for extending along the roof surface, said bend extending in a longitudinal direction of the strip, said first profile portion being laterally defined by said bend and a free lateral side edge running in parallel to said bend, the sheet material of said first profile portion being continuous from the bend to the free lateral side edge, wherein the first profile portion comprises a separation line running in the longitudinal direction of the profile strip in a specific distance from the free lateral side edge, said separation line facilitating separation of an outer part of the first profile portion.

BRIEF DESCRIPTION OF THE SEVERAL VIEWS OF THE DRAWINGS

Examples of the invention will now be explained below with reference to the very schematical drawing, in which.

DETAILED DESCRIPTION OF THE INVENTION

Figure 1:
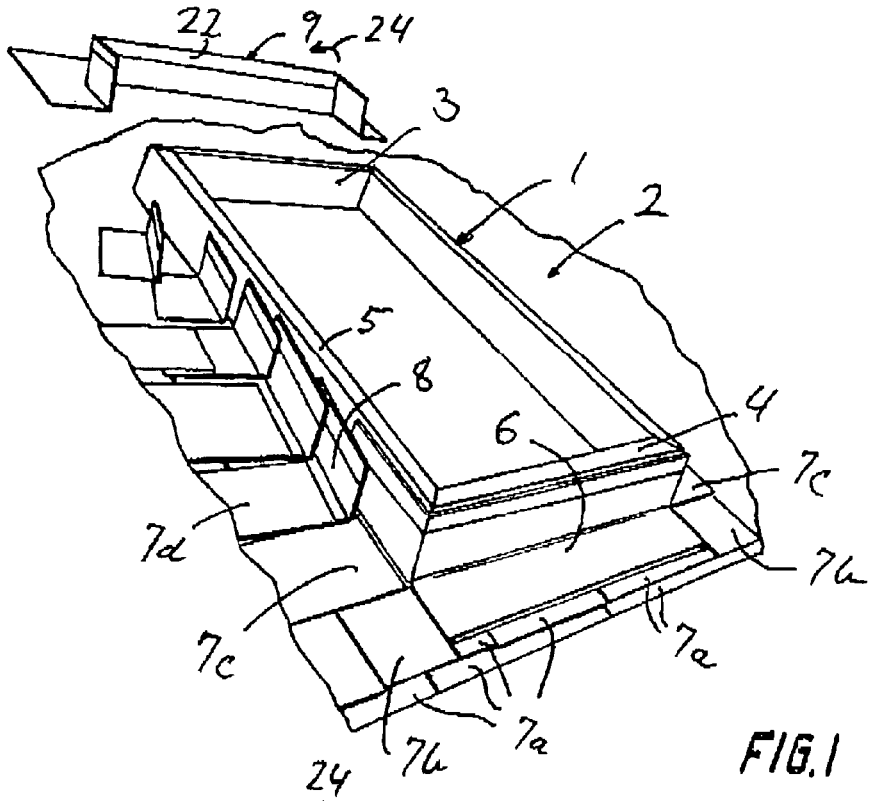
FIG. 1 is a perspective view of a curb during mounting of a flashing.

FIG. 1 shows a constructional element in the shape of a curb 1 for a skylight, the curb rising from the surface 2 of an inclined roof. The curb 1 comprises a curb top part 3, a curb bottom part 4 and curb side parts 5. The curb 1 is build on site from timber of dimensions 2"×6" (inches).

FIG. 1 further illustrates installation of a flashing and a roof covering in the shape of shingles. A flashing bottom part 6 extending along the curb bottom part 4 and lower parts of the curb side parts 5 has been mounted overlaying lower shingles 7*a*. Intermediate shingles 7*b* and 7*c* have been mounted overlaying the ends of the flashing bottom part 6. A first piece 8 of flashing side part is ready for mounting overlapping the flashing bottom part 6 and the upper intermediate shingle 7*c* following which a further intermediate shingle 7*d* will be mounted overlaying the first piece 8 of flashing side part. This procedure is continued as known per se until the curb side parts 5 are provided with flashing. Finally a flashing top part 9 is mounted and the roof covering with shingles is finished.

It should be noted that 'lower' and 'intermediate' in relation to the shingles refers to their position on the roof surface, i.e. below or beside the curb 1.

Figure 2:
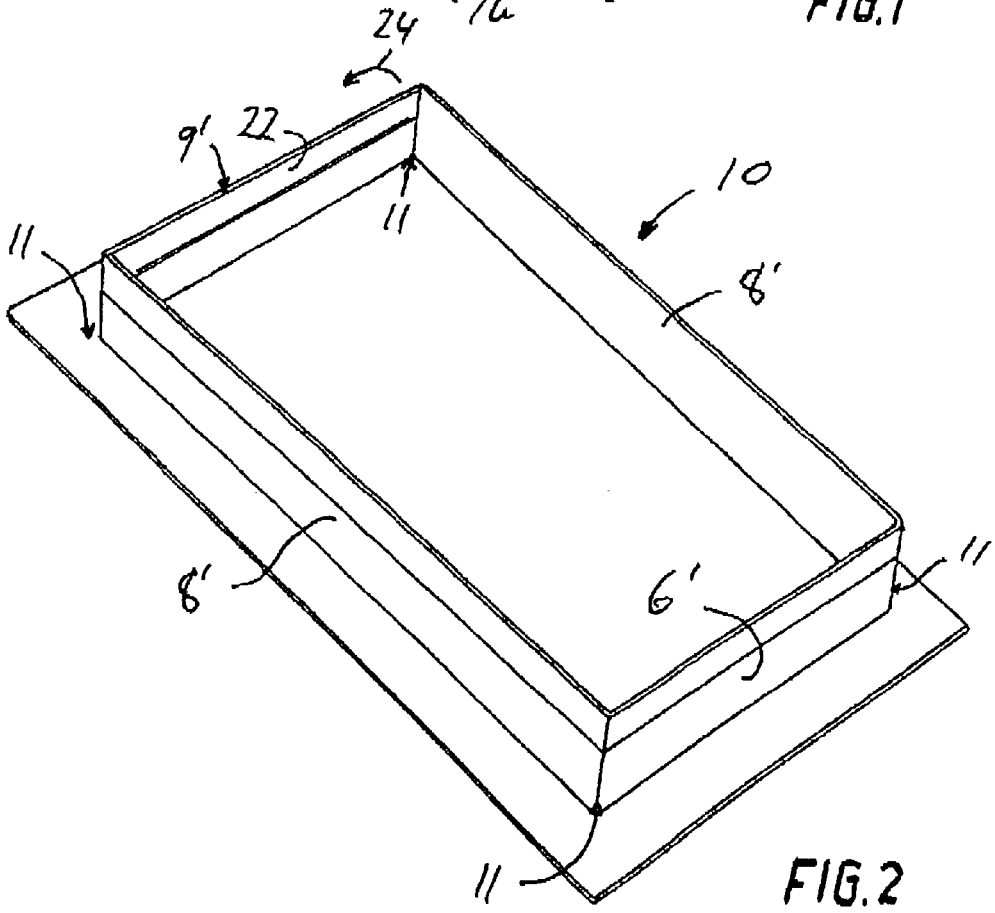
FIG. 2 is a perspective view of a flashing in another embodiment.

FIG. 2 shows a flashing frame 10 with a bottom part 6', side parts 81 and a top part 9'. The parts of the frame 10 are made from sheet material, e.g. of a rigid material such as metal or hard plastic like PVC and normally zinc, steel or aluminum, provided in profile strips which are connected at corners 11 of the frame 10. The bottom part 6 and top part 9 of the flashing shown in FIG. 1 correspond to bottom part 6' and top part 9' with minor portions of the side parts 8' of the flashing frame 10 in FIG. 2, respectively.

The flashing frame 10 may be mounted on a curb 1 as an alternative to the flashing shown in FIG. 1. Thus the flashing frame 10 would be mounted subsequently to the mounting of the lower shingles 7*a* shown in FIG. 1, but prior to the mounting of the intermediate shingles 7*b*–7*d* shown in FIG. 1.

Figure 4:
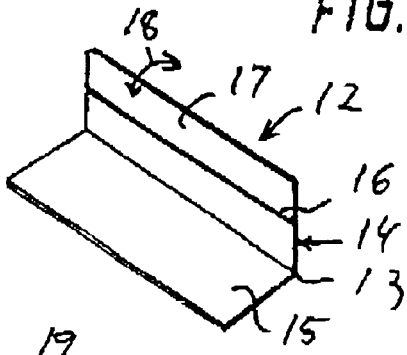
FIGS. 4 and 4*a* is a perspective view of a piece of profile strip and a cross section of its first profile portion in a preferred embodiment.
Figure 4A:
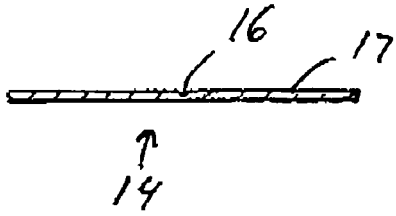

The flashing side parts and bottom parts shown in FIG. 1 and 2 are made from sheet material profile strip 12 as shown in FIG. 4 and 4*a*. The profile strip 12 comprise a piece of sheet material which by a bend 13 is divided into a first profile portion 14 for abutment against the curb 1 and a second profile portion 15 for extending along the roof surface 2. The first profile portion 14 is provided with a separation line 16, which in the preferred embodiment is a score line with a cross section as indicated in FIG. 4*a*. By bending an outer part 17 of the first profile portion back and forth as indicated by double arrow 18 in relation the strip 12 the outer part 17 is quite easily broken off thus reducing the height of the first profile portion 14 by the width of the outer part 17. Thus it is possible in a secure manner to adapt the flashing to a curb made from timber of dimensions 2"×4" (inches). It will be appreciated that the width of the outer part 17 is approximately 2" (inches).

The separation line 16 and the outer part 17 of the first profile portion 14 is indicated in FIGS. 1 and 2 on flashing side parts 8, 8' and flashing bottom parts 6, 6'. In order to make possible the bending back and forth of e.g. the outer part 17 of the bottom parts 6, 6' the corners 11 are initially brought down to the separation line 16.

Figure 3:
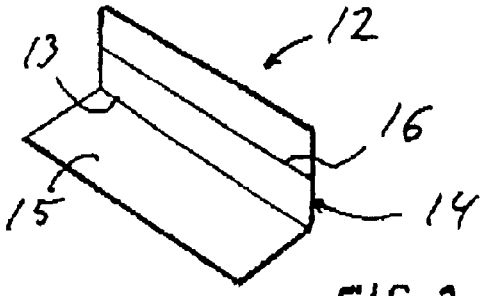
FIG. 3 is a perspective view of a piece of profile strip in one embodiment.

FIG. 3 shows a strip in which the separation line 16 is merely a visible indication along which the first profile portion 14 may be cut by means of a suitable cutting tool.

Figure 5:
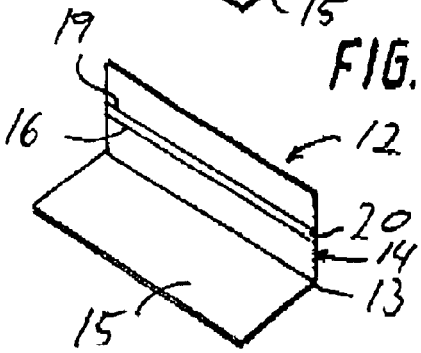
FIGS. 5, 6 and 5*a*, 6*a* are perspective views of pieces of profile strip and cross sections of their first profile portions in further embodiments.
Figure 5A:
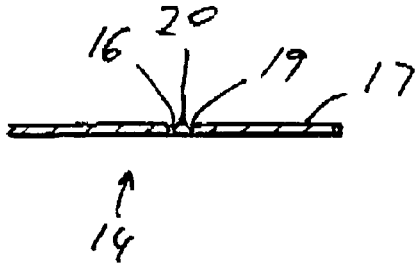

FIGS. 5 and 5*a* show a strip in which a second score line 19 is provided in the outer part 17 of the first profile portion 14. The second score line 19 running parallel to the separation line 16, which in this case is also a score line thus providing a tear strip 20 between the two score lines. The tear strip 20 may be grabbed e.g. by pliers and torn out thus separating the outer part 17 from the first profile portion 14.

Figure 6:
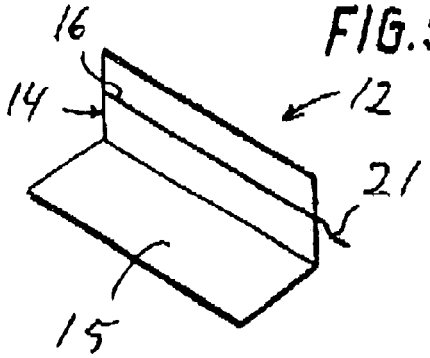
Figure 6A:
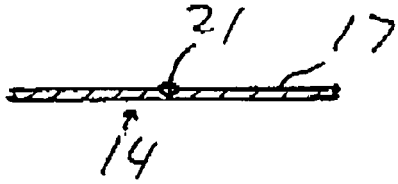

FIGS. 6 and 6*a* show a strip whereby a string 21 e.g. of steel is embedded in, e.g. rolled into, the material of the first profile portion 14. Thus the string 21 defines the separation line. By pulling the string 21 the outer part 17 may be separated from the first profile portion 14.

A rectilinear outer part 22 of the flashing top part 9 or the top part 9' of the flashing frame 10 is connected to the to their respective first profile portions through a bead 23 facilitating bending down the outer part 22 as indicated by arrow 24 in stead of separating the outer part 22 of the flashing top part. It will however be appreciated that separation could be applied to the outer part of the flashing top part also.

It will be appreciated that although the invention has above been described in relation to specific embodiments the scope of protection is not limited to those embodiments, but may be varied within the scope of the claims.

We claim:

1. A flashing for weather proof sealing of a transition between a roof covering and a constructional element rising from a roof surface, said flashing comprising a sheet material flashing profile strip divided by a bend into a first profile portion for abutment against the constructional element and a second profile portion for extending along the roof surface, said bend extending in a longitudinal direction of the strip, said first profile portion being laterally defined by said bend and a free lateral side edge running in parallel to said bend, the sheet material of said first profile portion being continuous from the bend to the free lateral side edge, wherein the first profile portion comprises a separation line running in the longitudinal direction of the profile strip in a specific distance from the free lateral side edge, said separation line facilitating separation of an outer part of the first profile portion.

2. A flashing according to claim 1, wherein the separation line is a score line.

3. A flashing according to claim 2, wherein a second score line is present in the outer part of the first profile portion said second score line running parallel to the separation line.

4. A flashing according to claim 1, wherein the separation line is a visible indicating line.

5. A flashing according to claim 1, wherein the separation line is defined by a string, which is embedded in the first profile portion.

6. A flashing for weather proof sealing of a transition between a roof covering and a constructional element rising from a roof surface, said flashing comprising a top part, a bottom part and two opposed side parts, said side parts each comprising a number of pieces of a sheet material flashing profile strip divided by a bend into a first profile portion for abutment against the constructional element and a second profile portion for extending along the roof surface, said bend extending in a longitudinal direction of the strip, said first profile portion being laterally defined by said bend and a free lateral side edge running in parallel to said bend, the sheet material of said first profile portion being continuous from the bend to the free lateral side edge, wherein the first profile portion comprises a separation line running in the longitudinal direction of the profile strip in a specific distance from the free lateral side edge, said separation line facilitating separation of an outer part of the first profile portion.

7. A flashing according to claim 6, wherein the separation line is a score line.

8. A flashing according to claim 7, wherein a second score line is present in the outer part of the first profile portion said second score line running parallel to the separation line.

9. A flashing according to claim 6, wherein the separation line is a visible indicating line.

10. A flashing according to claim 6, wherein the separation line is defined by a string, which is embedded in the first profile portion.

11. A flashing for weather proof sealing of a transition between a roof covering and a constructional element rising from a roof surface, said flashing comprising a top part, a bottom part and two opposed side parts, said parts being connected to constitute a flashing frame for surrounding the constructional element, one of said parts comprising a sheet material flashing profile strip divided by a bend into a first profile portion for abutment against the constructional element and a second profile portion for extending along the roof surface, said bend extending in a longitudinal direction of said strip, said first profile portion being laterally defined by said bend and a free lateral side edge running in parallel to said bend, the sheet material of said first profile portion being continuous from the bend to the free lateral side edge, wherein said first profile portion comprises a separation line running in the longitudinal direction of the profile strip in a specific distance from the free lateral side edge, said separation line facilitating separation of an outer part of the first profile portion.

12. A flashing according to claim 11, wherein the separation line is a score line.

13. A flashing according to claim 12, wherein a second score line is present in the outer part of the first, profile portion said second score line running parallel to the separation line.

14. A flashing according to claim 11, wherein the separation line is a visible indicating line.

15. A flashing according to claim 11, wherein the separation line is defined by a string, which is embedded in the first profile portion.

* * * * *